US006161607A

United States Patent [19]

de Kimpe et al.

[11] Patent Number: 6,161,607

[45] Date of Patent: Dec. 19, 2000

[54] LIGHT CONTROL COVERING DEVICE FOR ARCHITECTURAL OPENINGS

[75] Inventors: Jan F. A. de Kimpe, Helmond; Nico Dekker, HE Rotterdam; André A. J. van Dijk, Den Haag, all of Netherlands

[73] Assignee: Hunter Douglas International N.V., Netherlands Antilles

[21] Appl. No.: 09/196,475

[22] Filed: Nov. 19, 1998

Related U.S. Application Data

[63] Continuation of application No. 08/810,929, Mar. 5, 1997, abandoned.

[30] Foreign Application Priority Data

Mar. 8, 1996 [EP] European Pat. Off. ..... 96200634

[51] Int. Cl.[7] ..... A47G 5/02

[52] U.S. Cl. ..... 160/238; 160/121.1; 160/166.1; 160/368.1

[58] Field of Search ..... 160/237, 238, 160/130, 168.1 R, 166.1 R, 121.1, 291, 242, 329, 321, 368.1, 378, DIG. 7

[56] References Cited

U.S. PATENT DOCUMENTS

| | | | |
|---|---|---|---|
| 2,617,329 | 11/1952 | Dreyer | 160/166.1 R X |
| 3,065,785 | 11/1962 | Taber | 160/237 |
| 4,372,432 | 2/1983 | Waine et al. | 192/8 |
| 4,419,982 | 12/1983 | Eckels | 160/368.1 X |
| 4,453,585 | 6/1984 | Ruggeberg, Sr. et al. | 160/368.1 X |
| 4,510,986 | 4/1985 | Schwankl | 160/368.1 X |
| 4,867,222 | 9/1989 | Roman et al. | 160/368.1 X |
| 4,896,901 | 1/1990 | Ekelund | 283/90 |
| 5,025,848 | 6/1991 | Prochaska | 160/368.1 |
| 5,287,908 | 2/1994 | Hoffman et al. | 160/121.1 |
| 5,313,999 | 5/1994 | Colson et al. | 160/121.1 |
| 5,392,932 | 2/1995 | Colson et al. | 160/84.07 |
| 5,394,922 | 3/1995 | Colson et al. | 160/121.1 |

FOREIGN PATENT DOCUMENTS

| | | | |
|---|---|---|---|
| 2697558 | 5/1994 | France | 160/166.1 |

*Primary Examiner*—Daniel P. Stodola
*Assistant Examiner*—Bruce A Lev
*Attorney, Agent, or Firm*—Dorsey & Whitney LLP

[57] ABSTRACT

A light control covering device for an architectural opening comprises control hardware and a flexible sheet, the control hardware enabling different translucency positions of the flexible sheet, wherein the flexible sheet is of a stretchable nature. The control hardware is adapted to arrange for at least a first position of the flexible sheet, in which position the flexible sheet is mainly unstretched, and a second position of the flexible sheet, in which position the flexible sheet is substantially stretched.

31 Claims, 13 Drawing Sheets

LIGHT CONTROL COVERING DEVICE FOR ARCHITECTURAL OPENINGS

CROSS-REFERENCE TO RELATED APPLICATIONS

This application is a continuation of U.S. application Ser. No. 08/810,929 filed Mar. 5, 1997 (now abandoned), and claims priority to European Application No. 96200634.2 filed Mar. 8, 1996.

BACKGROUND OF THE INVENTION

The invention underlying the present disclosure relates to a light control covering device for an architectural opening comprising a control means and a flexible sheet, the control means arranging for different translucency positions of the flexible sheet.

Such a light control covering device can be used to control light transmission through an architectural opening, such as a window.

Such a light control covering device is known inter alia from U.S. Pat. No. 5,445,204. In the subject patent the flexible sheet consists of alternating opaque and translucent members and the control means provides that the light control covering device can be controlled between an opaque position and a translucent position of the flexible sheet.

A disadvantage of such a light control covering device is that the subject covering device is not easy and not cheap to manufacture, as the covering device arrangement is relatively complex.

The invention has as an object to provide a light control covering device, which meets the disadvantage as mentioned above.

SUMMARY OF THE INVENTION

A light control covering device in accordance with the invention is characterized in that the flexible sheet is of a stretchable nature and in that the control means are adapted to arrange for at least a first position of the flexible sheet, in which position the flexible sheet is substantially unstretched, and a second position of the flexible sheet, in which position the flexible sheet is substantially stretched. The invention is based on the view that use of a stretchable sheet offers possibilities for light control. The unstretched and stretched positions provide different translucency of the flexible sheet; in the unstretched, i.e. the first position the flexible sheet blocks more light than in the stretched, i.e. the second position. The flexible sheet can be simply fixed and stretched near an architectural opening, whereby the control means are capable to adapt tension of the flexible sheet. The light control covering device may however also be embodied as a roller shade or any other blind.

A further embodiment of a light control covering device in accordance with the invention is characterized in that the flexible sheet is stretchable in only one direction. Use of material that is stretchable in only one direction achieves that the flexible sheet does not show serious edge deformation along edges of the flexible sheet parallel to the stretch direction.

A further embodiment of a light control covering device in accordance with the invention is characterized in that the flexible sheet is of a fabric material. The fabric material provides a pleasant appearance for the light control covering device. As the subject covering device will often be used near a window as a sun blind, the fabric material should be resistant to ultra violet radiation.

A further embodiment of a light control covering device in accordance with the invention is characterized in that the flexible sheet is retractable. The flexible sheet may have a length defined by first and second opposite edges and a retracting mechanism may be attached to said first edge. Further, a movable member may be attached to said second edge and the movable member and the retracting mechanism may be movable relative to one another. The control device may further comprise a locking device for holding the movable member in at least one position remote from the retracting mechanism to deploy a portion of the length between the retracting mechanism and the movable member. The retracting mechanism may be a roller.

The roller may be driven through a clutch device capable of activating and deactivating a brake device. The locking device may comprise mutually engaging members on the movable member and along a path of movement of the movable member.

Alternatively, both the roller and the movable member may be driven through a first clutch device capable of disengaging a brake device acting on a fixed mounting structure. A second clutch device may be interposed between a drive shaft driving the movable member and the roller concentrically disposed with respect to the drive shaft and the second clutch device may be operated to drive the roller independent of the drive shaft.

At least one clutch device may comprise a wrap spring. The movable member may be driven by an endless cord loop extending along each lateral side of the light control covering device.

BRIEF DESCRIPTION OF THE DRAWINGS

Above-mentioned and other (more detailed) aspects of the invention are further described and illustrated with reference to the accompanying drawing, wherein.

In the figures corresponding parts are referred to by similar reference signs.

DESCRIPTION OF THE PREFERRED EMBODIMENT

Figure 1:
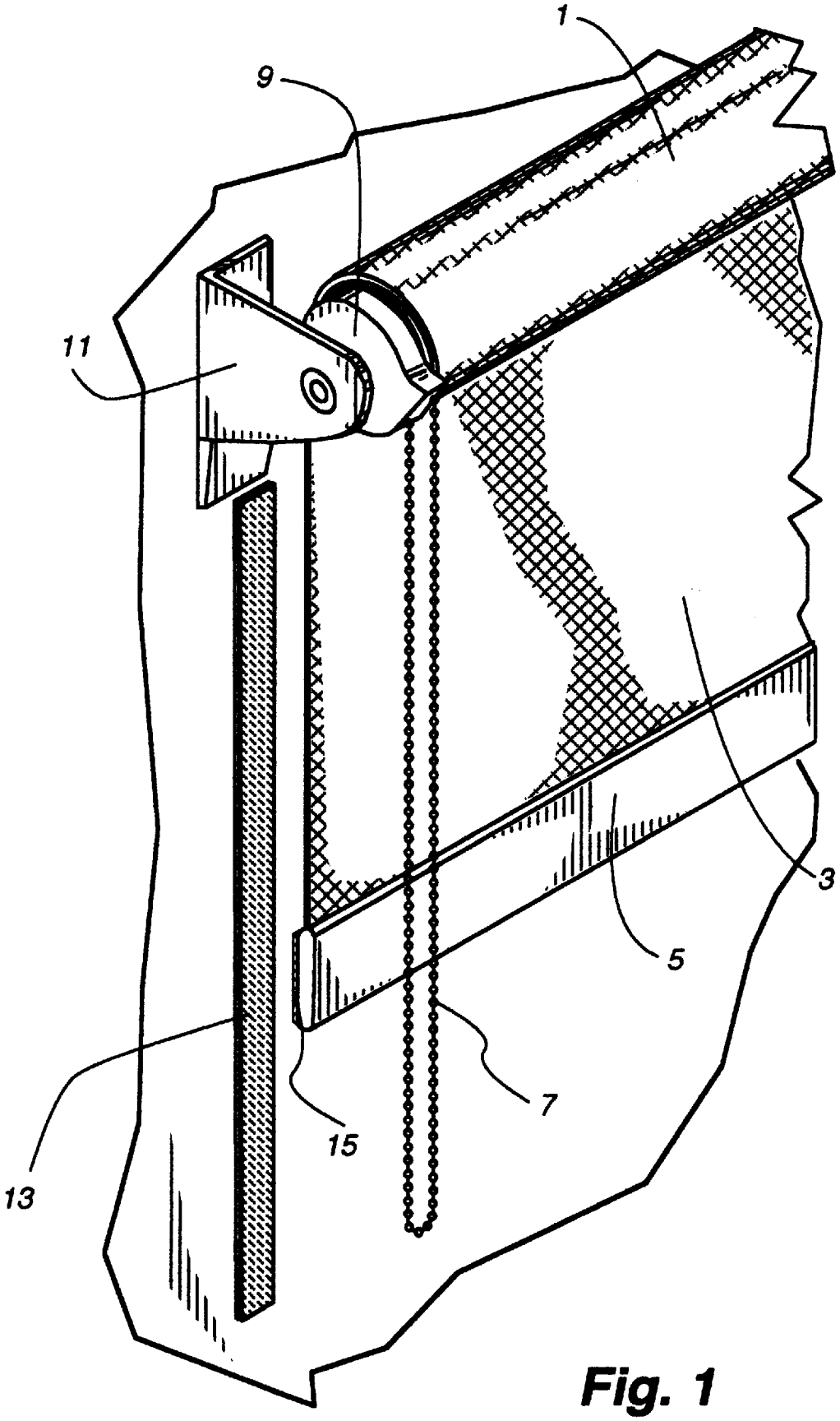
FIG. 1 is a partial perspective showing a first embodiment of a light control covering device in accordance with the invention.
Figure 2:
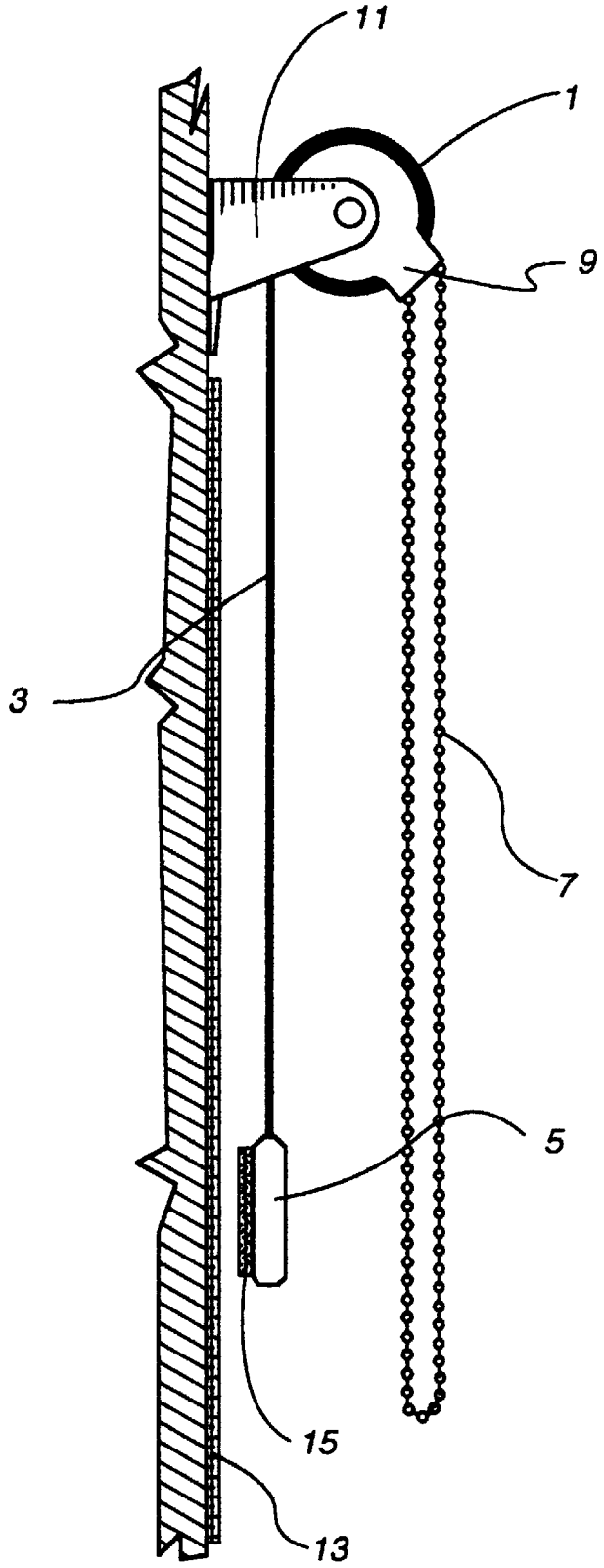
FIG. 2 is a side view of the first embodiment of the light control covering device of FIG. 1.

A first embodiment of the covering device in accordance with the invention is shown in FIGS. 1 and 2. FIG. 1 shows a roller 1 which enables a flexible sheet 3 to be retracted by rolling the sheet up on the roller 1. At the lower edge of the sheet 3 is attached a movable member, embodied as a rail 5. Raising and lowering of the movable rail 5 while retracting and deploying the sheet 3 from the roller 1 is accomplished by an operating cord 7 which is shown here in the form of a ball cord. The shown ball cord is for purposes of illustration only and the operating cord 7 could also be provided with a plain cord. The drive from the operating cord 7 is transferred in rotating the roller 1 through a clutch device, here a conventional drive clutch 9. Such drive clutches are conventional and usually comprise a form of brake means which normally frictionally engages the roller 1 to a mounting bracket 11, so that the roller 1 does not rotate on its own. Once the operating cord 7 is acted on, the brake means is disengaged and allows repositioning of the movable rail 5 together with the sheet 3. One suitable type of clutch is described in U.S. Pat. No. 4,372,432. Along the side edges of the travelling path of the movable rail 5 is attached a length of a VELCRO tape 13. The confronting rear side of the movable rail 5 is provided with a cooperating piece of VELCRO material 15, which may be engaged with the VELCRO tape 13 at any desired position. The sheet 3 consists in accordance with the invention of a stretchable fabric, which is elastic and which has a larger open area component in a stretched position than in an unstretched position.

One possible form of fabric is a knitted fabric material that predominantly stretches in one direction only. Such a material offers translucency when stretched and opacity when relaxed.

Light regulation can now be obtained by operating the screen as follows. With the VELCRO elements 13, 15 disengaged, the movable rail 5 is lowered to a desired position with the sheet 3 extending over a portion of an architectural opening (not shown). In the desired position the movable rail 5 is brought into engagement with the VELCRO tape 13 and held thereby. Reverse operation of the operating cord 7 and the roller 1 in a direction to wind up the sheet 3 will cause the sheet to stretch to a greater or lesser extent. The drive clutch 9 by the brake mechanism will hold the sheet in any of the stretched positions. If tension would require other attachment means the VELCRO type attachment means for the movable rail 5 may be replaced by more structural means such as a fixed hook or the like. As said, FIG. 2 shows a side view of the covering device of FIG. 1.

Figure 3:
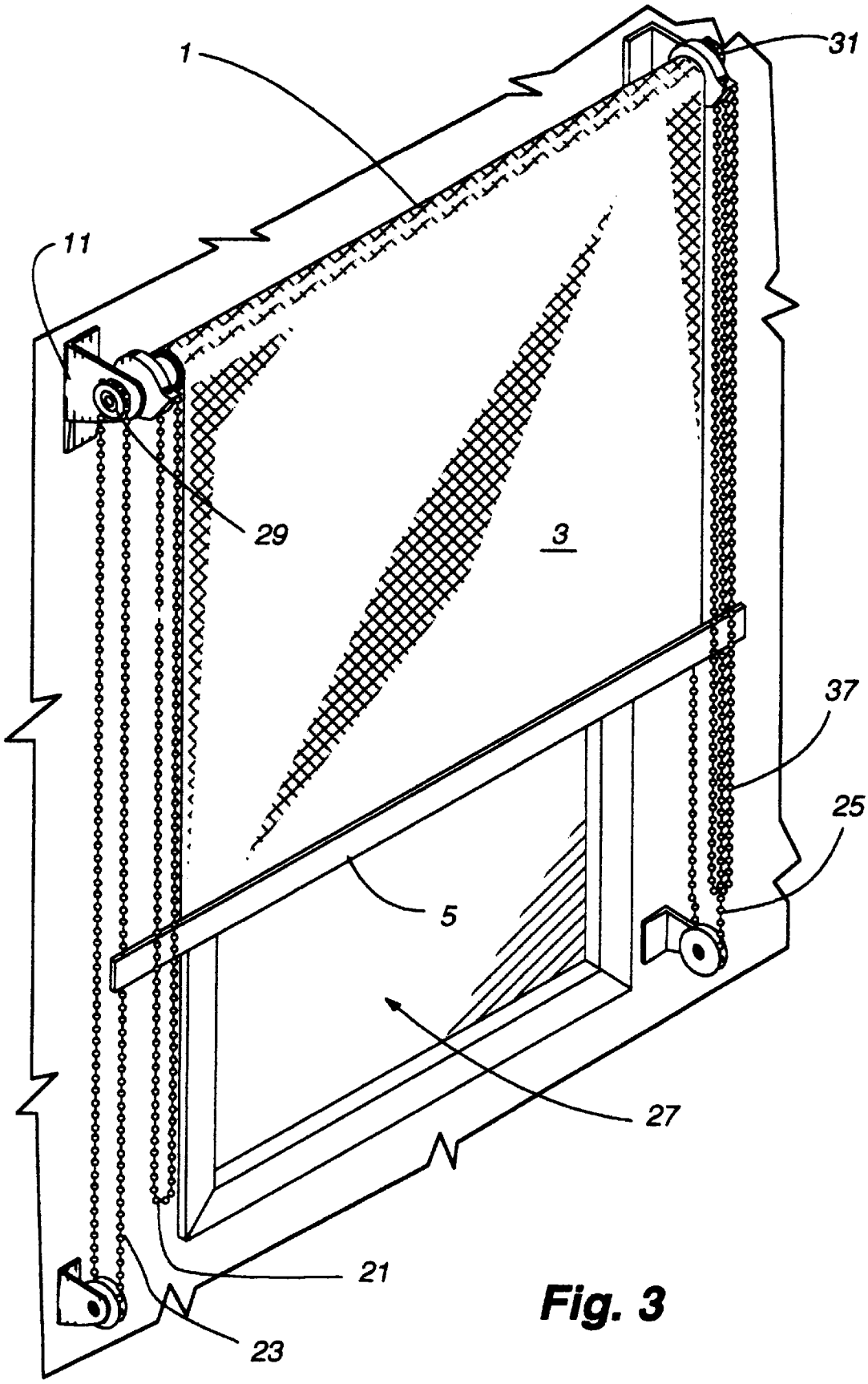
FIG. 3 is a perspective view showing a second embodiment of a light control covering device in accordance with the invention.
Figure 4:
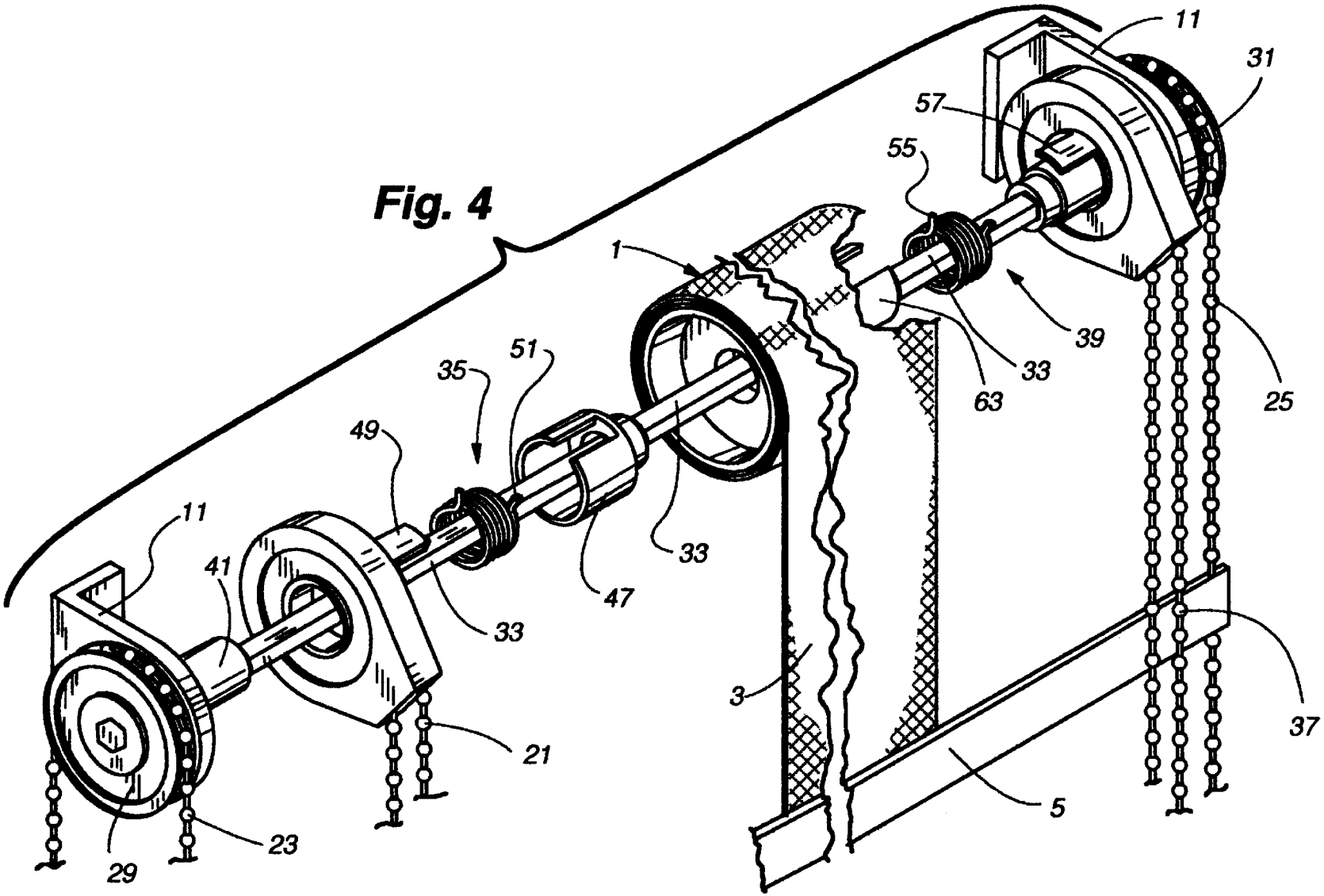
FIG. 4 is a partially exploded view showing the upper end of the second embodiment of the light control covering device of FIG. 3.

FIGS. 3 and 4 show a second embodiment of the light control covering device in accordance with the invention, which embodiment is provided with separate operating drives for lowering the sheet 3 and for adjusting tension of the sheet 3. A left hand operating cord 21 raises and lowers the movable rail 5, through looped ball chain drives 23, 25 connected to the rail on either side of a window opening 27. Both ball chain loops 23 and 25 are driven by drive pulleys 29 and 31 which are attached to a common drive shaft 33, as shown in FIG. 4. The common drive shaft 33 is driven by the operating cord 21 and a first clutch and a brake mechanism 35 that frictionally engages the drive shaft 33 to the mounting bracket 11 if the operating cord 21 is not actuated. A right hand operating cord 37 drives the roller 1, or the roller 1 is driven by the common shaft 33 and the operating cord 37 moves with the left hand operating cord. This is the result of a second (modified) clutch device 39 which operates between the roller 1 and the common shaft 33. In this way operation of the left hand operating cord 21 not only lowers the movable rail 5, but also allows the roller to rotate with the drive shaft 33 as the second clutch device 39 operates as a clutch between the common drive shaft 33 and the roller 1. Once the drive shaft 33 is no longer driven the subject shaft 33 is frictionally held to the bracket 11 through sleeve portion 41 whereas the roller is frictionally held to shaft 33 by the second clutch device 39. This may be the case if the covering is in a position as illustrated in FIG. 3. Stretching of the sheet material 3 in a lowered or partly lowered position, such as in FIG. 3, can be effected through operating cord 37. If the operating cord 37 is operated, this action deactivates the second clutch device 39 and allows rotation of the roller 1 independent of the common drive shaft 33. The movable rail 5 is thereby kept in an adjusted position and operation of the right hand operating cord 37 in the appropriate direction will tension the sheet 3 so that the sheet may achieve a stretched position for light regulation.

Figure 5:
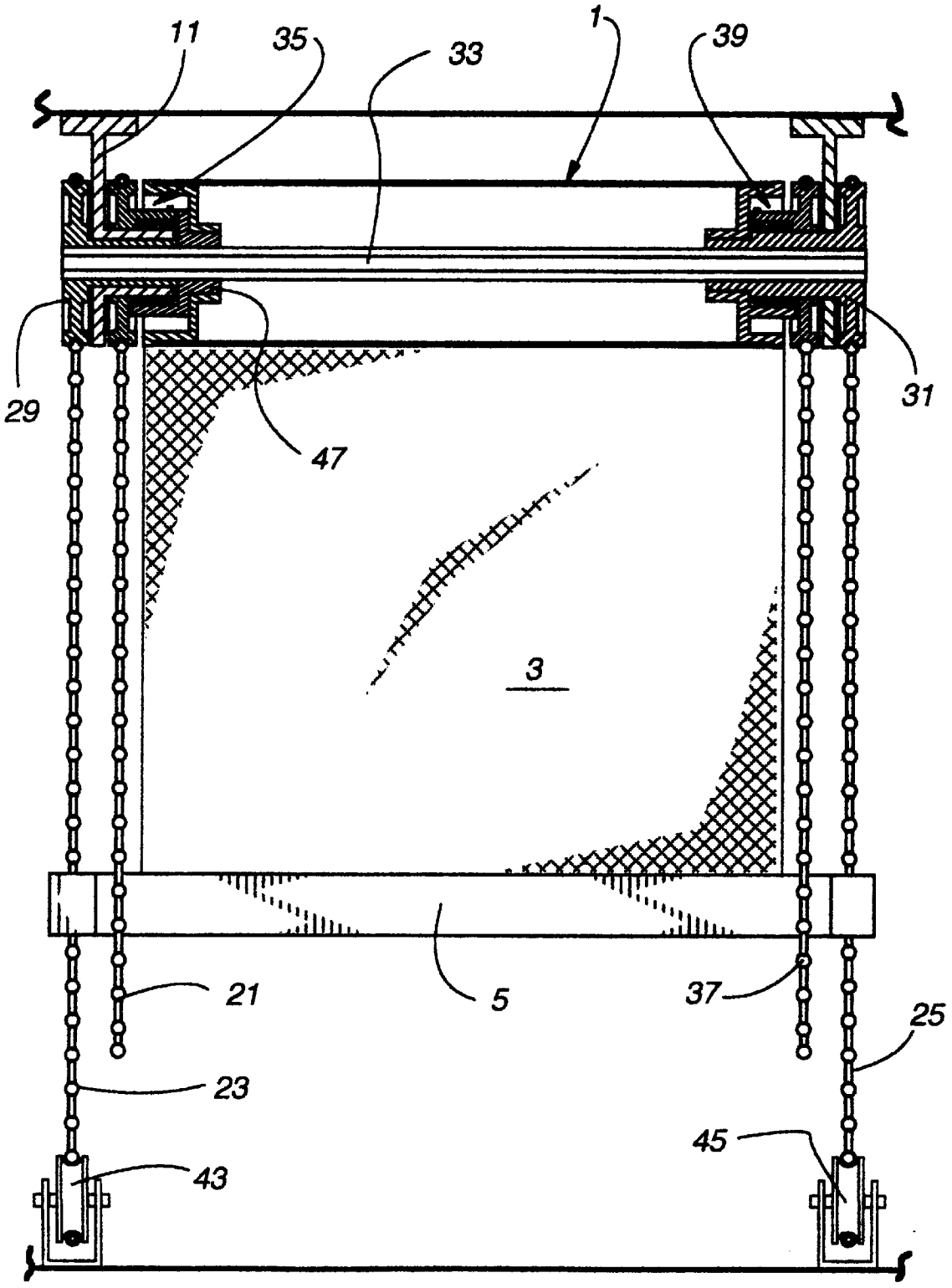
FIG. 5 is a partially sectioned frontal view showing a third embodiment of a light control covering device in accordance with the invention.
Figure 6:
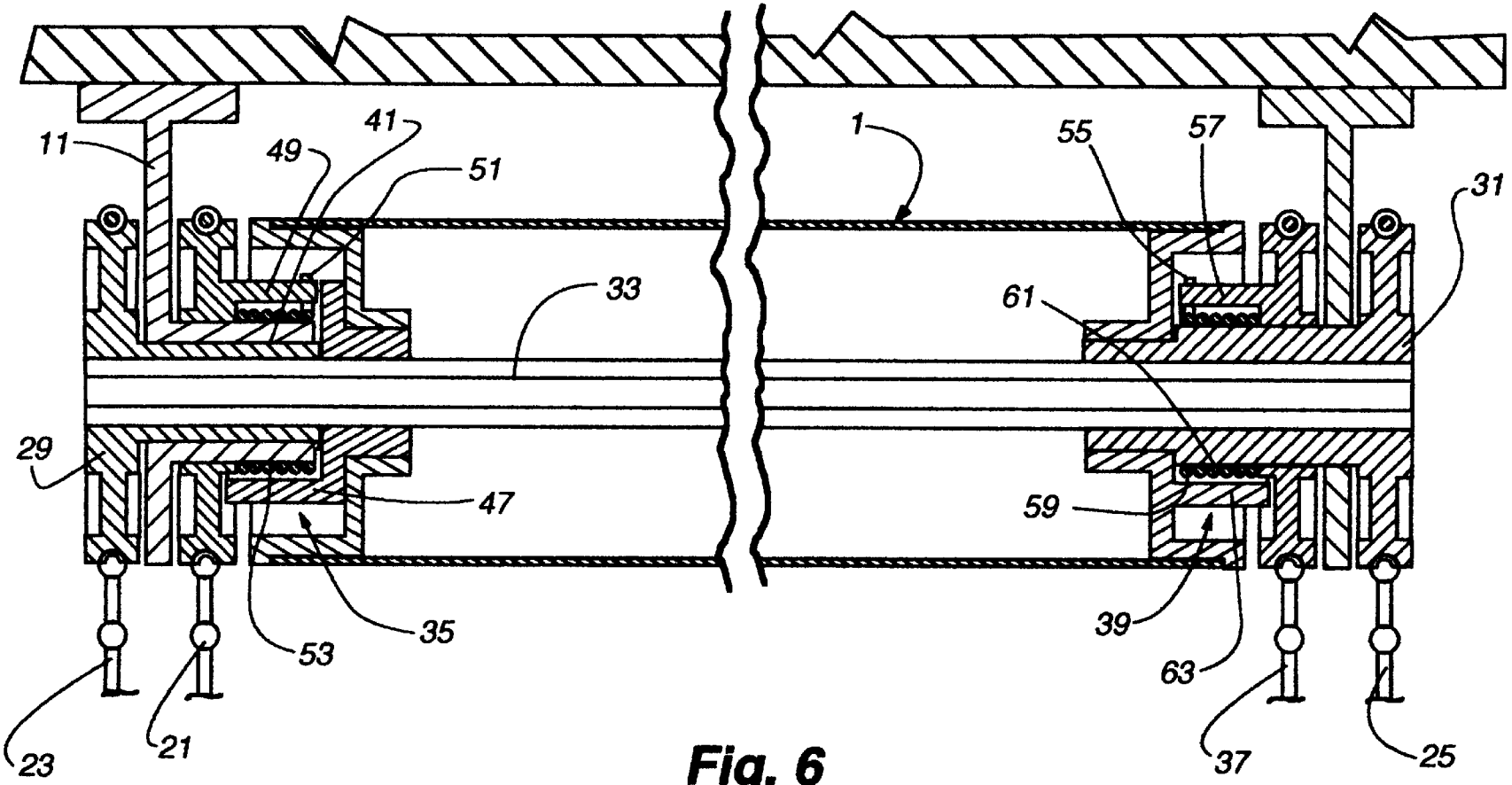
FIG. 6 is a cross section through the upper end of the third embodiment of the light control covering device of FIG. 5.

FIGS. 5 and 6 show a third embodiment, being a modified version of the embodiment of FIGS. 3 and 4. As shown in FIG. 3 the ball chain loops 23 and 25 at the bottom ends are entrained over return pulleys as referenced by 43 and 45 in FIG. 5. Mounted for rotation with the common drive shaft 33 are the left hand drive pulley 29, the right drive pulley 31 and a hollow sleeve 47. The hollow sleeve 47 as best shown in FIG. 6 at the upper end is provided with an aperture in which an elongate finger 49 is positioned. Upwardly directed end portions 51 of a wrap spring 53 are interposed between the elongate finger 49 and edges of the aperture in the hollow sleeve 47. The operation of the first clutch 35 is as follows. If the shaft 33 were attempted to be rotated through ball chain loops 23, 25 or through the roller 1, then the hollow sleeve 47 by the edges of the aperture will engage the wrap spring 53 in a direction narrowing its windings on the sleeve portion 41. Rotation of shaft 33 thereby will be prohibited. If on the contrary operating cord 21 were operated to rotate shaft 33, then the elongate finger 49 would act on one of the spring ends 51 in a direction which enlarges the windings of the wrap spring 53 on the sleeve portion 41 and shaft 33 will be disengaged from mounting bracket 11. Since FIG. 6 is a cross section through the brake structure only one of the spring ends 51 is shown, but the arrangement of such wrap spring ends is conventional and is described in the U.S. Pat. No. 4,372,432 referenced herein above. The second clutch device 39 shown at the right hand end of FIG.

6 operates slightly different. Here again only one of the outwardly deflected spring ends 55 is shown. Spring end 55 is shown behind a further elongate finger 57 and the other spring end which is not shown would be in front of the further finger 57 with respect to FIG. 6. The spring end 55 belongs to a further wrap spring 59 which is fitted around a circumferential extension 61 of the drive pulley 31. The perimeter of wrap spring 59 beyond the further finger 57 and the spring ends 55 is surrounded by an essentially hollow cylinder 63 which has a slot like aperture to accommodate the spring ends 55 as well as further finger 57. The hollow cylinder 63 is part of the roller structure 1 and rotates therewith. Rotation of the roller 1 will also result in simultaneous movement of the right hand operating cord 37, but will not interfere with the proper operation of the covering device. However, when the left hand operating cord 21 is no longer operated the shaft 33 is held in a stationary position by brake mechanism 35 gripping the mounting bracket 11. The roller 1 then is held stationary with respect to shaft 33 through the second clutch device 39. Operation of roller 1 independent of the ball chain loops 23 and 25 driving the movable rail 5, is now possible by operating the right hand operating cord 37. Such operation allows the further finger 57 to open the windings of wrap spring 59 which disengages the roller 1 from shaft 33. Adjustment can thereby be made to the tensioning and stretching of the sheet 3 shown in FIG. 5. After the driving force is removed from operating cord 37 the second clutch device 39 holds the adjusted position in respect of shaft 33.

Figure 7:
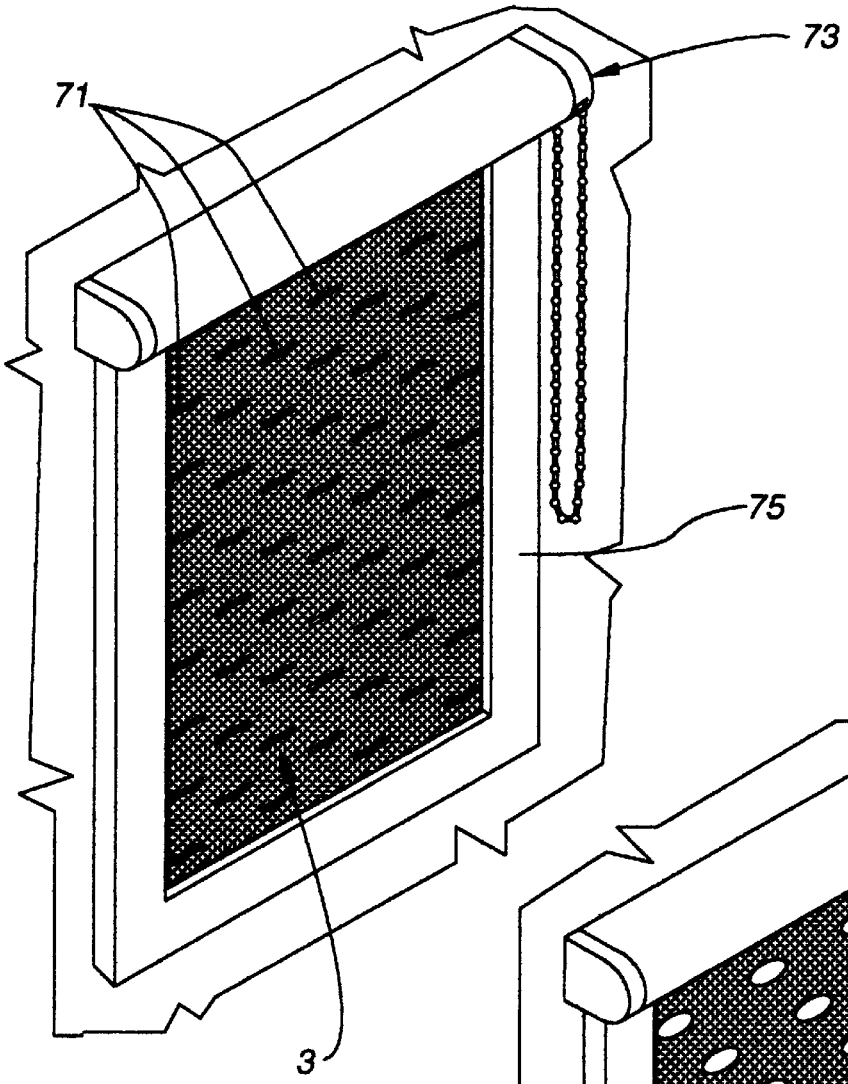
FIG. 7 is a perspective view of a fourth embodiment of light control covering device in accordance with the invention.
Figure 8:
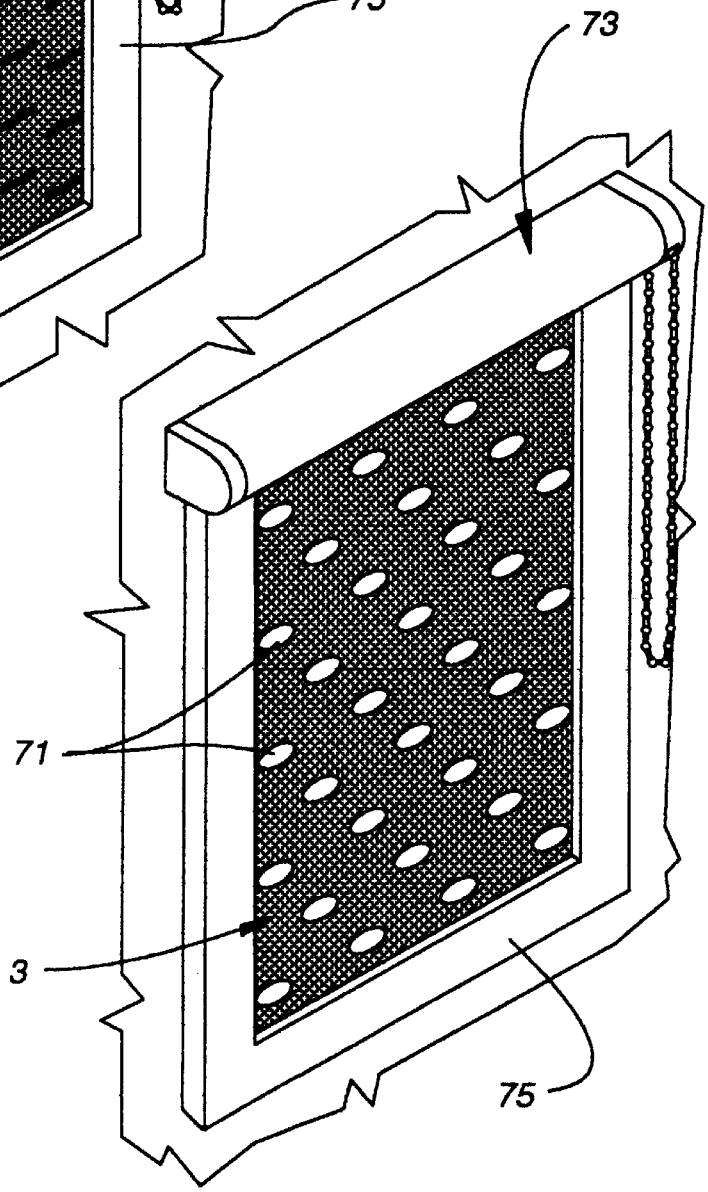
FIG. 8 is a view similar to FIG. 7 but showing the light covering device in a stretched position.

A fourth embodiment is shown in FIGS. 7 and 8. In this version the flexible sheet material 3 has additionally been provided with slits 71 which increase the flexibility in the tensioning direction. As is seen in FIG. 8 upon tensioning the slits 71 take the form of more or less round apertures. Apart from reducing the required tensioning and lateral contraction of certain elastic fabrics, the slits 71 also provide an additional decorative effect. The operating hardware of the fourth embodiment can be any of those disclosed in connection with the first through third embodiments and is only generally indicated at 73.

Also shown is a perimeter valance or slide guiding channel 75 which covers the edges of the shade material against light leakage and also useful in hiding any lateral contraction of the covering material.

A fifth embodiment is shown in FIGS. 9A through 11 and is adapted to be movable in a horizontal direction.

In this embodiment the light control covering is akin to a drape or curtain and to this end is provided with an upper 81 and a lower guide track 83. In the open condition illustrated in FIG. 9A the window pane 85 is uncovered with the flexible sheet material 3 gathered at both lateral sides of the window.

Figure 9A:
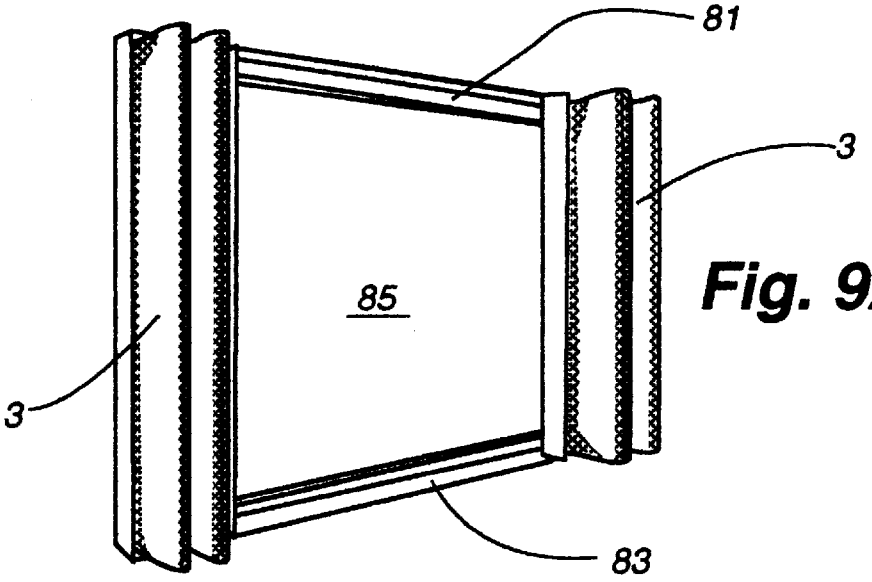
FIG. 9A is a perspective view of a fifth embodiment according to the invention in a fully opened position.
Figure 9B:
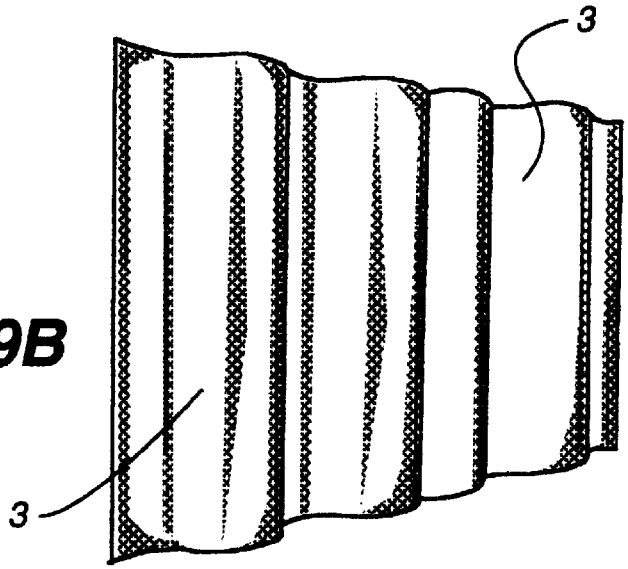
FIG. 9B is a view similar to FIG. 9A but now showing the fifth embodiment in a fully closed position.

FIG. 9B illustrates the closed condition in which the sheet material 3 is extended over the window area but untensioned to allow for a pleated drape impression. As can be seen in the plan views of FIGS. 10A and 10B, which correspond with the situations of FIGS. 9A and 9B respectively, the sheet material 3 is connected to the upper and lower guide tracks 81, 83 only through spaced carriers 87 movable therein. This results in the formation of several pleatable sections of the sheet material 3.

Figure 9C:
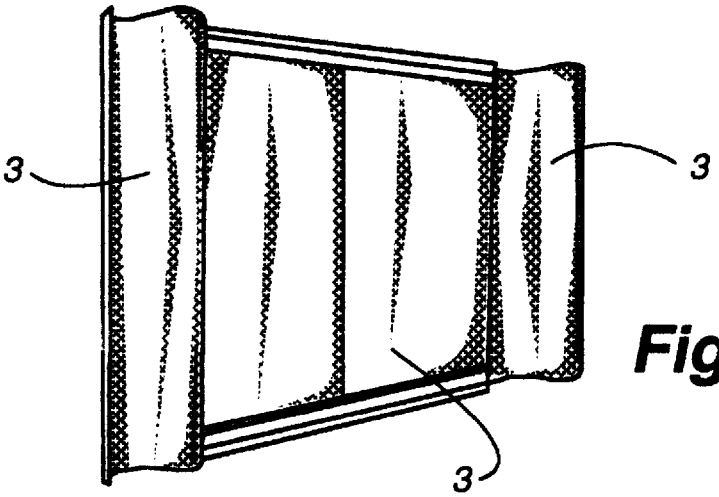
FIG. 9C is a view similar to FIGS. 9A and 9B but showing the fifth embodiment in a closed but translucent, stretched position.
Figure 10A:
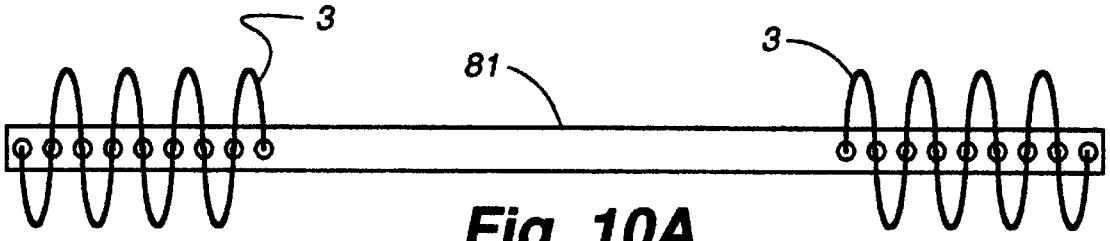
FIG. 10A is a schematic top plan view of FIG. 9A.
Figure 10B:
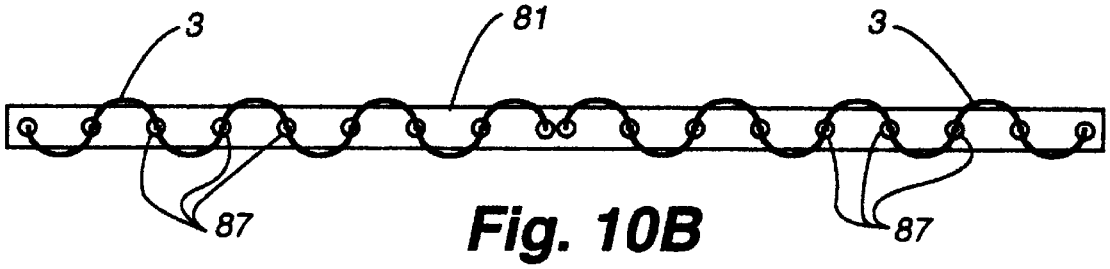
FIG. 10B is a schematic top plan view of FIG. 9B.
Figure 10C:
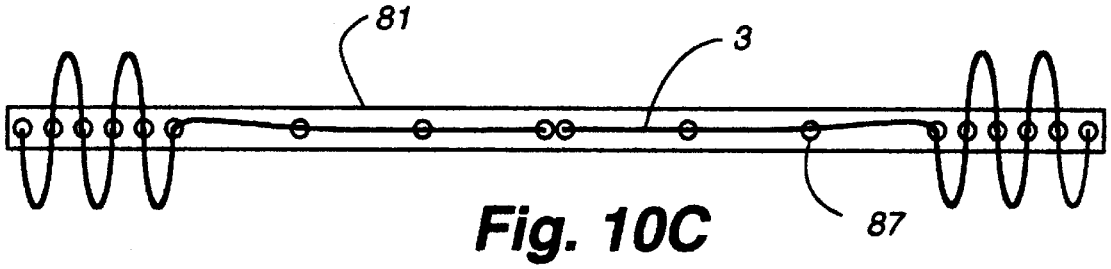
FIG. 10C is a schematic top plan view of FIG. 9C.

FIGS. 9C and 10C show a further position in which one or more of these sections are stretched to provided a translucent coverage over the window area.

The remaining untensioned sheet portions are arranged on each lateral side of the window opening.

Figure 11:
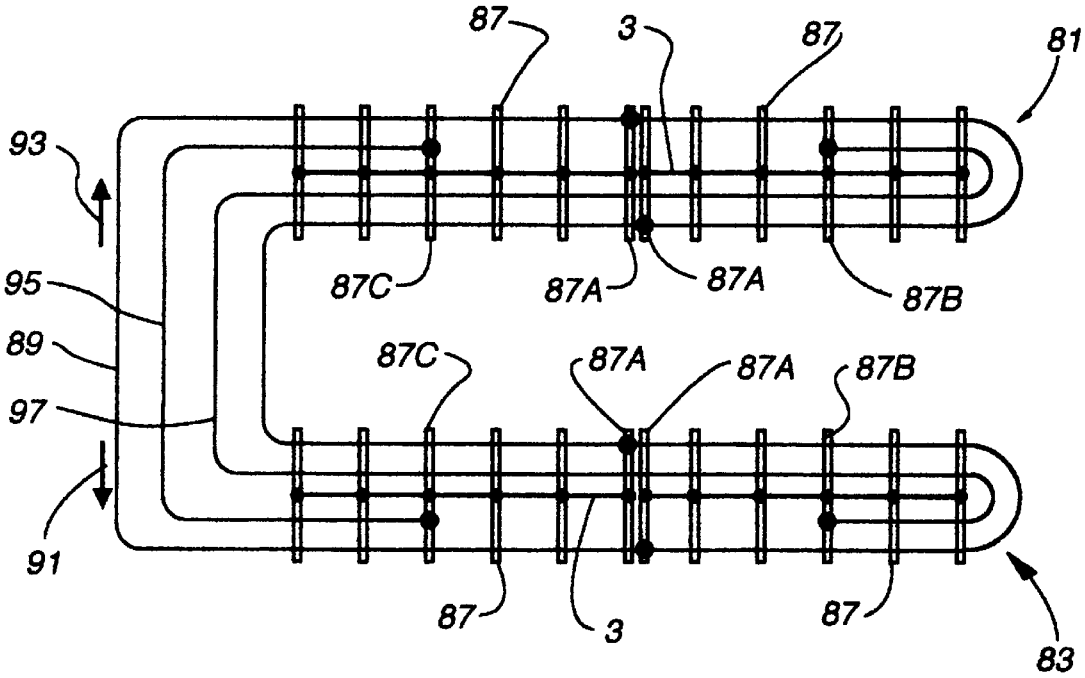
FIG. 11 is a schematic front view of an operating means for the fifth embodiment.

FIG. 11 schematically shows a possible operating means for this fifth embodiment. The internals of the upper track 81 and lower track 83 are again schematically shown to comprise a number of carriers 87. A first cord 89 is looped through both upper and lower tracks and is connected along its path to master carriers 87A. The attachment is schematically indicated by a bold dot. By moving cord 89 in the direction of arrow 91 the master carriers 87A will be moved in opposite directions to open the light control covering 3. Movement of cord 89 in the direction of arrow 91 will eventually result in the position of FIGS. 9A and 10A. Operation of cord 89 in the reverse direction of arrow 93 results in the position of FIGS. 9B and 10B, which corresponds to the position of FIG. 11. Further visible in FIG. 11 are the additional cords 95 and 97 which can be manipulated to move the submaster carriers 87C in directions resulting in the position shown in FIGS. 9C and 10C.

Figure 12:
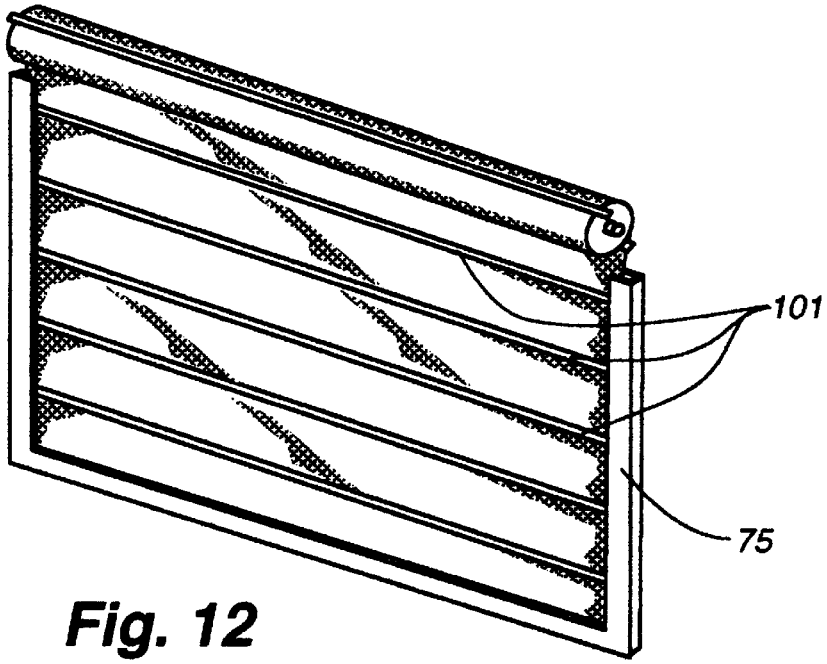
FIG. 12 is a general view of a sixth embodiment.
Figure 13:
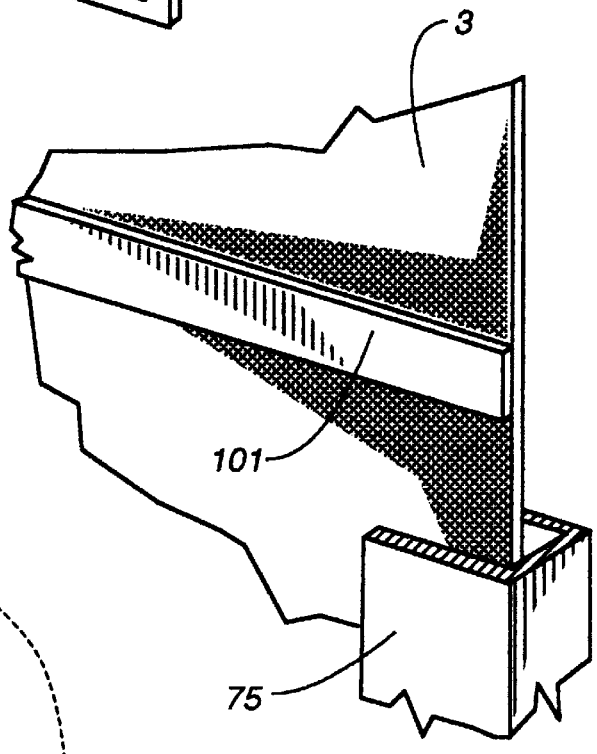
FIG. 13 is a detail, partly broken away view of the sixth embodiment.
Figure 14:
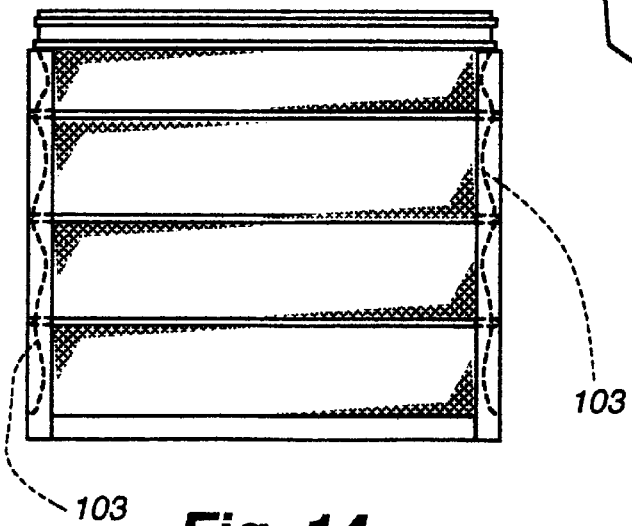
FIG. 14 is a front elevation of the sixth embodiment.

A sixth embodiment is shown in FIGS. 12 through 14. Although it has been possible to manufacture fabric materials that have an elastic behavior in one direction significantly superior to that in a direction perpendicular thereto, there is for these fabrics still a tendency to contract in a direction transverse to the tensioning direction. This effect can be hidden from view by a side channel 75 such as again illustrated in FIG. 12. However, if the length of the material in the direction of stretch must be large then the required depth for the side channels may grow beyond aesthetical proportions.

For this reason the sixth embodiment has a number of regularly spaced reinforcing means 101 across the width of its sheet material 3.

FIG. 14 shows the resultant reduced edge contraction 103 which can be hidden from sight by a side channel 75 of modest dimensions. Additionally the beams 101 may be guided as illustrated by the same side guiding channels. This additionally guards the covering device against wind or other mechanical attack. The beams 101 may have a strip like form and can be attached by adhesive welding or mechanical means such as fasteners.

Figure 15:
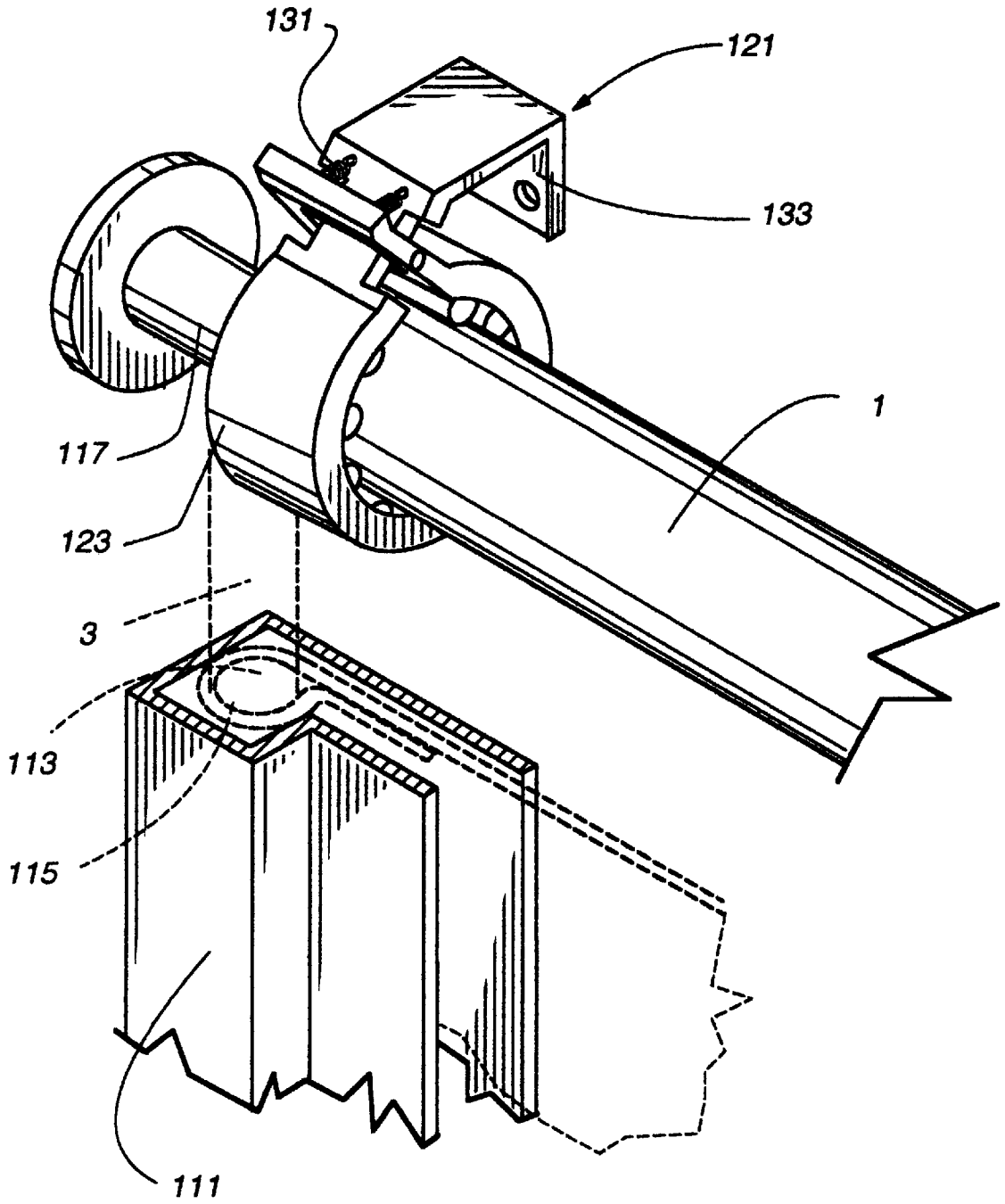
FIG. 15 is a perspective view of a seventh embodiment showing a side guide and roller detail.
Figure 17:
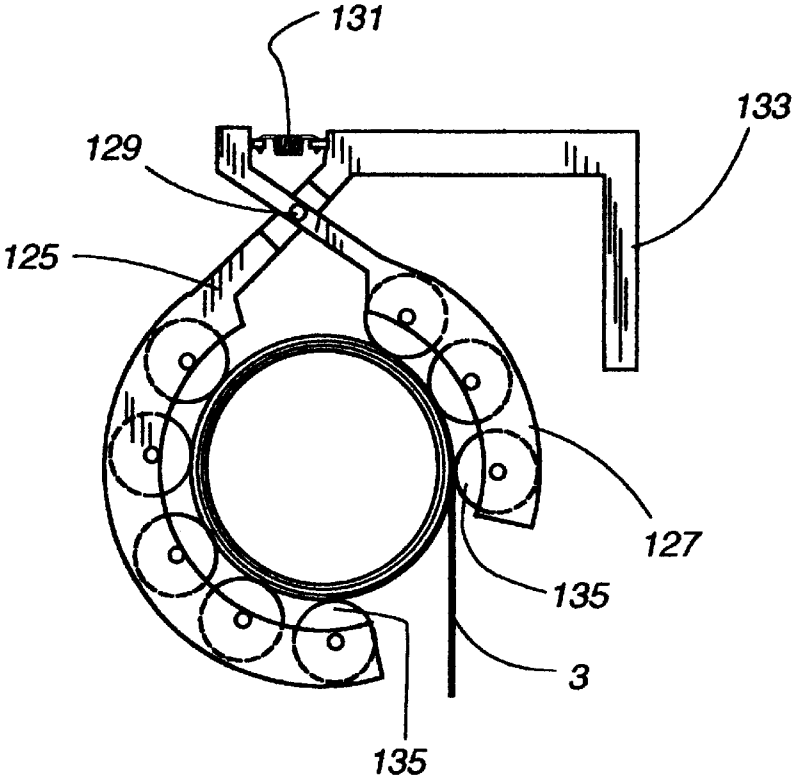
FIG. 17 is a partial side elevation of the structure of FIG. 16.
Figure 16:
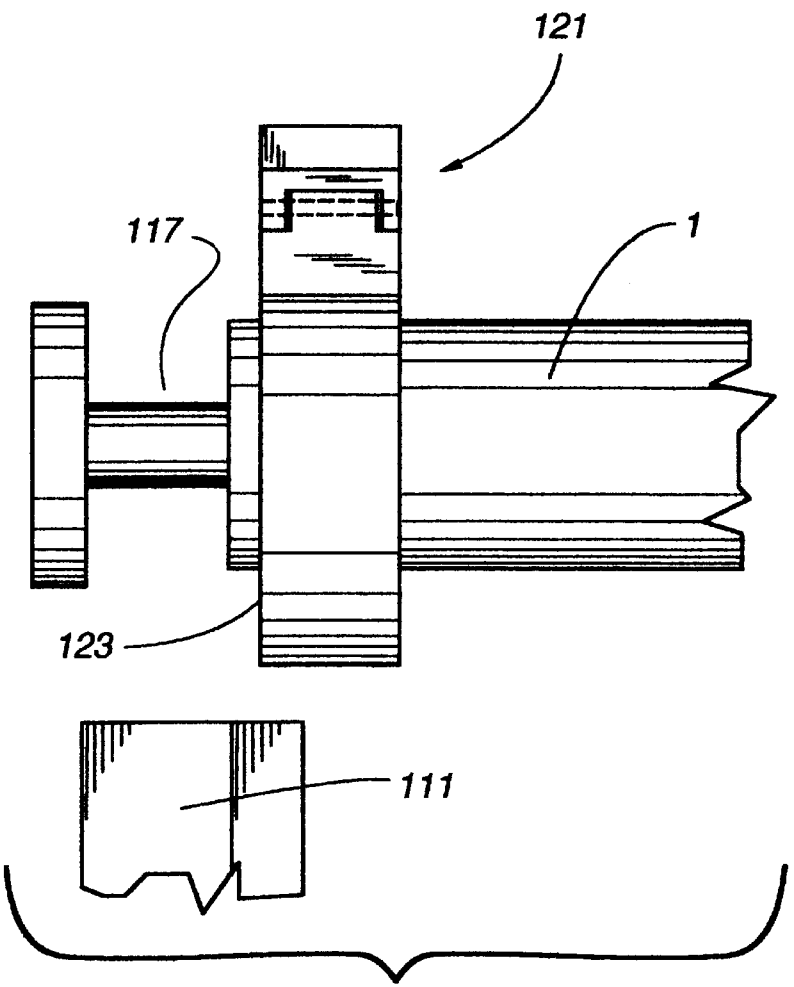
FIG. 16 is a partial front elevation of the seventh embodiment.

FIGS. 15 through 17 show a seventh embodiment having again different means to control the edge contraction. This type of covering device is provided with a side channel 111 that includes an elongate undercut cavity in which an edge bead 113 of the sheet 3 can be retained. As illustrated with dotted lines in FIG. 15 the edge bead 113 is contained in a hem 115. In this embodiment the sheet 3 is retractable on roller 1 and the bead portion requires more room for winding than the flat area of the sheet. Accordingly roller 1 is provided with a reduced portion 117 at both of its longitudinal ends (only one being shown in the partial view of FIG. 15). Similar arrangements are known for roller shades and insect screens but are less suitable for the elastic sheet material of the present invention which also may show a tendency of lateral contraction while being rolled up. The sixth embodiment therefor has been provided with an additional guide arrangement 121. This guide arrangement has a bearing surface 123 which retains the edge bead 113 well within the reduced portion 117 of the roller 1. The guide arrangement 121 also adapts itself to the varying diameter of the roller upon winding or unwinding of the sheet material 3.

As best seen in FIG. 17 the guide arrangement 121 comprises a first jaw 125 and a second jaw 127 which are pivotally connected at 129. The jaws 125 and 127 are biased towards one another by springs 131 and the first jaw 125 is provided with a bracket portion 133 for attachment to a wall surface. On the interior face of each jaw are a number of rollers 135 which reduce the friction of the jaws on the roller 1. Advantageously the guiding arrangement 121 can be combined with a bracket for carrying the roller.

Figure 18:
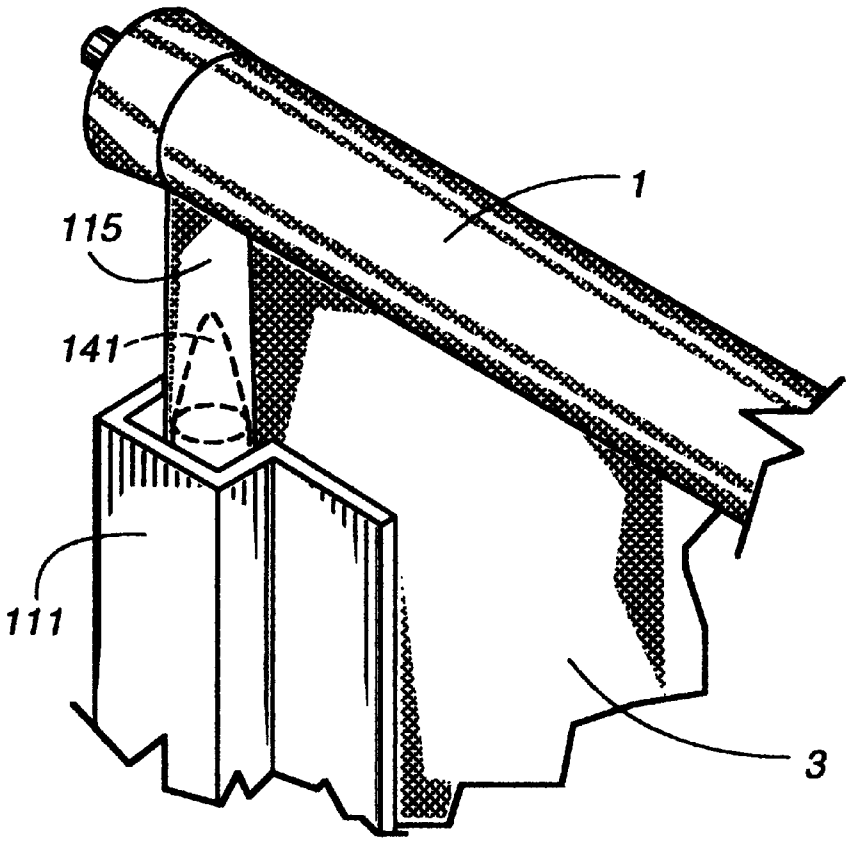
FIG. 18 is a perspective view of a modified form of side guiding incorporated in an eighth embodiment.

FIG. 18 shows a further modification in which the hem 115 is essentially empty but is lowered over a fixed needle 141 positioned in an undercut side channel 111. Upon winding of the sheet material 3 on the roller 1 the hem 115 is essentially flat.

The invention is not limited to the above-described embodiments. Within the scope of the invention a man ordinarily skilled in the art may provide some further embodiments. As mentioned above, the covering device does not necessarily be embodied by an extendable and retractable shade. On the other hand any kind of control means may be applied to control the flexible sheet.

What is claimed is:

1. A light control covering device for an architectural opening comprising a control means and a flexible fabric sheet, the control means enabling different translucency positions of the sheet, wherein the sheet is of a returnably stretchable nature and the sheet itself as used in the covering device includes a plurality of discernible fibers and the control means is adapted to arrange the sheet into a first position, in which the sheet is mainly unstretched and lies within a first plane, and a second position, in which the sheet is substantially stretched with the fibers positioned to define spaces therebetween while the sheet remains substantially within said first plane.

2. A light control covering device as claimed in claim 1, wherein the flexible fabric sheet is stretchable in only one direction.

3. A light control covering device as claimed in claim 1 or 2, wherein the sheet is elastic.

4. A light control covering device as claimed in claim 3, wherein said sheet is more elastic in a first direction than in a second direction that is perpendicular to the first direction.

5. A light control covering device for an architectural opening comprising a control means and a flexible fabric sheet, the control means enabling different translucence positions of the sheet, wherein the sheet is of a returnably stretchable nature and the sheet itself as used in the covering device includes a plurality of discernible fibers and the control means is adapted to arrange the sheet into a first position, in which the sheet is mainly unstretched and lies within a first plane, and a second position, in which the sheet is substantially stretched with the fibers positioned to define spaces therebetween while the sheet remains substantially within said first plane, and wherein said sheet is stretchable in only one direction and is retractable.

6. A light control covering device for an architectural opening comprising a control means and a flexible fabric sheet, the control means enabling different translucency positions of the sheet, wherein the sheet is of a returnably stretchable nature and the sheet itself as used in the covering device includes a plurality of discernible fibers and the control means is adapted to arrange the sheet into a first position, in which the sheet is mainly unstretched and lies within a first plane, and a second position, in which the sheet is substantially stretched with the fibers positioned to define spaces therebetween while the sheet remains substantially within said first plane, and wherein the sheet is retractable.

7. A light control covering device as claimed in claim 5 or 6, wherein the flexible sheet has a length defined by first and second opposite edges and a retracting mechanism is attached to said first edge.

8. A light control covering device as claimed in claim 7, wherein a movable member is attached to said second edge and the movable member and the retracting mechanism are movable relative to one another.

9. A light control covering device as claimed in claim 8, wherein the light control covering device comprises a locking device for holding the movable member in at least one position remote from the retracting mechanism to deploy a portion of the length between the retracting mechanism and the movable member.

10. A light control covering device as claimed in claim 9, characterized in that the locking device comprises mutually engaging members on the movable member and along a path of movement of the movable member.

11. The light control covering device as claimed in claim 9, wherein the retracting mechanism is a roller.

12. A light control covering device as claimed in claim 11, wherein the roller is driven through a clutch device capable of activating and deactivating a brake device.

13. A light control covering device as claimed in claim 12, wherein at least one clutch device comprises a wrap spring.

14. A light control covering device as claimed in claim 11, wherein both the roller and the movable member are driven through a first clutch device capable of disengaging a brake device acting on a fixed mounting structure.

15. A light control covering device as claimed in claim 14, wherein at least one clutch device comprises a wrap spring.

16. The light control covering device as claimed in claim 8, wherein the retracting mechanism is a roller.

17. A light control covering device as claimed in claim 16, wherein the roller is driven through a clutch device capable of activating and deactivating a brake device.

18. A light control covering device as claimed in claim 17, wherein at least one clutch device comprises a wrap spring.

19. A light control covering device as claimed in claim 16, wherein both the roller and the movable member are driven through a first clutch device capable of disengaging a brake device acting on a fixed mounting structure.

20. A light control covering device as claimed in claim 19, wherein at least one clutch device comprises a wrap spring.

21. The light control covering device as claimed in claim 5 or 6, wherein the retracting mechanism is a roller.

22. A light control covering device as claimed in claim 21, wherein the roller is driven through a clutch device capable of activating and deactivating a brake device.

23. A light control covering device as claimed in claim 22, wherein at least one clutch device comprises a wrap spring.

24. A light control covering device as claimed in claim 21, wherein both the roller and the movable member are driven through a first clutch device capable of disengaging a brake device acting on a fixed mounting structure.

25. A light control covering device as claimed in claim 24, wherein at least one clutch device comprises a wrap spring.

26. A light control covering device for an architectural opening comprising a control means and a flexible fabric sheet, the control means enabling different translucency positions of the sheet, wherein the sheet is of a returnably stretchable nature and the sheet itself as used in the covering device includes a plurality of discernible fibers and the control means is adapted to arrange the sheet into a first position, in which the sheet is mainly unstretched and lies within a first plane, and a second position, in which the sheet is substantially stretched with the fibers positioned to define spaces therebetween while the sheet remains substantially within said first plane, said sheet being stretchable in only one direction, being retractable, and wherein the sheet has a length defined by first and second opposite edges and a retracting mechanism attached to said first edge, said retracting mechanism being a roller.

27. A light control covering device for an architectural opening comprising a control means and a flexible fabric sheet, the control means enabling different translucency positions of the sheet, wherein the sheet is of a returnably stretchable nature and the sheet itself as used in the control device includes a plurality of discernible fibers and the control means is adapted to arrange the sheet into a first position, in which the sheet is mainly unstretched and lies within a first plane, and a second position, in which the sheet is substantially stretched with the fibers positioned to define spaces therebetween while the sheet remains substantially within said first plane, said sheet being retractable, and wherein the sheet has a length defined by first and second opposite edges and a retracting mechanism is attached to said first edge, said retracting mechanism being a roller.

28. A light control covering device as claimed in claim 26 or 27, wherein the roller is driven through a clutch device capable of activating and deactivating a brake device.

29. A light control covering device as claimed in claim 28, wherein at least one clutch device comprises a wrap spring.

30. A light control covering device as claimed in claim 26 or 27, wherein both the roller and the movable member are driven through a first clutch device capable of disengaging a brake device acting on a fixed mounting structure.

31. A light control covering device as claimed in claim 30, wherein at least one clutch device comprises a wrap spring.

* * * * *